United States Patent [19]

Allen

[11] 4,118,148

[45] Oct. 3, 1978

[54] DOWNHOLE WELL PUMP CONTROL SYSTEM

[75] Inventor: Loy F. Allen, Odessa, Tex.

[73] Assignee: Gulf Oil Corporation, Pittsburgh, Pa.

[21] Appl. No.: 685,295

[22] Filed: May 11, 1976

[51] Int. Cl.[2] ..... F04B 49/00

[52] U.S. Cl. ..... 417/12; 417/43; 417/44

[58] Field of Search ..... 417/12, 34, 43

[56] References Cited

U.S. PATENT DOCUMENTS

| | | | |
|---|---|---|---|
| 3,091,179 | 5/1963 | Echols | 417/415 |
| 3,247,798 | 4/1966 | Glasgow et al. | 417/43 |
| 3,854,846 | 12/1974 | Douglas | 417/12 |
| 3,963,374 | 6/1976 | Sullivan | 417/12 |

FOREIGN PATENT DOCUMENTS

| | | | |
|---|---|---|---|
| 2,336,323 | 6/1975 | Fed. Rep. of Germany | 417/12 |

*Primary Examiner*—William L. Freeh

[57] ABSTRACT

Operation of a downhole reciprocating oil well pump is controlled by displacement of the fluids discharged from the pump into a displacement cell closed at its upper end. Gas is trapped in the upper end of the displacement cell. Fluids flow from the lower end of the displacement cell through a dump valve into a flow line. The dump valve opens when the pressure in the displacement cell rises to a predetermined high pressure and remains open until the pressure drops to a predetermined lower pressure which may be the flowline pressure. Operation of the dump valve resets a timer that actuates a switch controlling a pumping unit that drives the downhole pump. Thus, control of the pumping unit is based on the volume of fluids displaced from the well by the pump.

11 Claims, 1 Drawing Figure

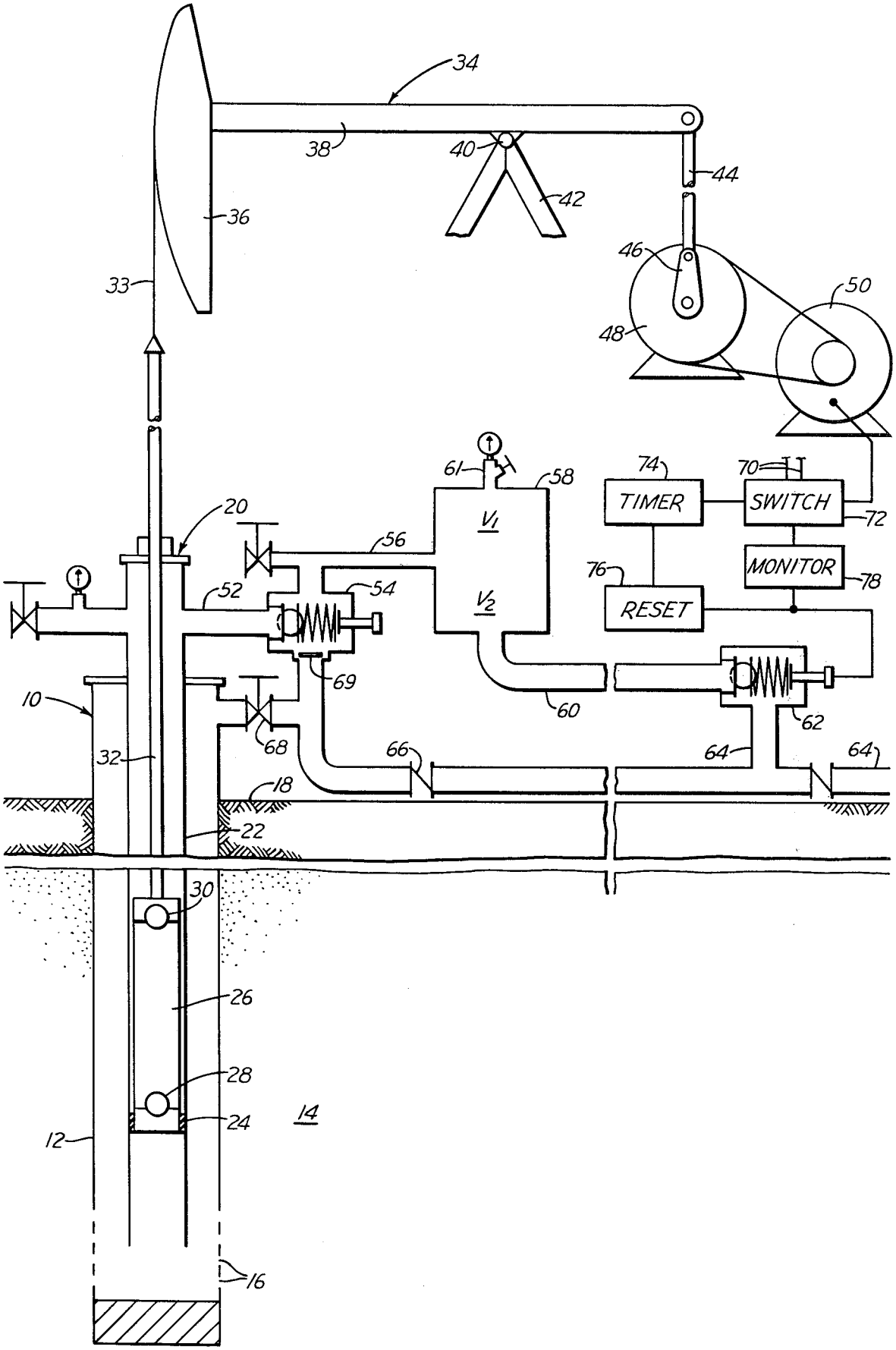
34
38
40
42
44
36
33
46
50
48
61
58
74
70
TIMER
SWITCH
72
20
56
V1
76
MONITOR
78
52
54
V2
RESET
69
10
60
62
68
66
64
64
32
18
22
30
26
28
14
24
12
16

DOWNHOLE WELL PUMP CONTROL SYSTEM

BACKGROUND OF THE INVENTION

1. Field of the Invention

This invention relates to oil wells and more particularly to a system for control of the operation of reciprocating downhole oil well pumps.

2. Description of the Prior Art

Although many oil wells will initially flow continuously because of the high pressure on the oil in the underground reservoirs penetrated by the well, there is a large number of wells that will produce only if oil is pumped from the borehole of the well. Those wells that are initially free flowing usually must be pumped after the reservoir has become partially depleted. The most common type of pump is a reciprocating pump that is installed at a depth in the well such that oil will flow from the surrounding reservoir into the borehole of the well and submerge the lower end of the pump. A plunger in the pump is connected through sucker rods extending upwardly through the well and a wellhead at the upper end of the well to a pumping unit driven by a suitable prime mover such as an electric or internal combustion motor.

If the maximum production from the well is to be obtained, the rate at which the pump will deliver oil to the surface is higher than the rate at which oil will flow into the well from the surrounding reservoir. To prevent operation of the pumping unit when there is insufficient liquid in the well for efficient pumping of well fluids, the pumping unit is periodically shut down to permit the accumulation of well fluids, particularly oil in the well. Because many wells are in remote locations, it is desirable to provide a system that will automatically control the operation of the pump to maintain a pumping efficiency above a preselected minimum.

In U.S. Pat. No. 2,550,093 of Smith, a system is disclosed in which the well fluids are pumped against a spring-loaded check valve. Operation of the pumping unit is controlled by a timer that cuts off the power supply to the pumping unit after pumping has proceeded continuously for a preselected period. Each pressure pulse from a stroke of the pump that opens the check valve causes resetting of the timer to the starting point of the preselected period.

In apparatus described in U.S. Pat. No. 3,274,940 of Cottrell, the pumping unit is controlled by a float-operated switch in a chamber in the discharge line from the well. If the downhole pump does not deliver liquids from the well at a rate high enough to cause the float chamber to fill to a level to actuate the float-operated switch, the pumping unit is shut down. A timer restarts the pump after it has been shut down for a preselected period. Other flow control systems are described in U.S. Pat. No. 2,690,713 of Urmann et al. in which the level of liquid in the well initiates a signal to control the pump operation; U.S. Pat. No. 3,075,466 of Agnew et al. in which variations in the current drawn by the electric motor for operating the pumping unit, etc. are used to control the motor of the pumping unit; and U.S. Pat. No. 3,854,846 of Douglas in which pressure pulses are used to reset a timer in a control system for the pumping unit. U.S. Pat. No. 3,854,846 discloses a specific electrical circuit for permanently shutting down the system until it is manually restarted if several restarts fail to cause flow high enough to actuate a reset signal.

SUMMARY OF THE INVENTION

This invention resides in a system for controlling the operation of a pumping unit driving a downhole reciprocating pump in which fluids discharged by the pump from the well are passed through a backpressure valve into a displacement cell having an inlet spaced from the top of the cell and an outlet in its lower end. A discharge line connected to the outlet from the displacement cell delivers fluids to a dump valve set to open and dump fluid from the displacement cell at a predetermined high pressure and remain open until the pressure falls to a preselected lower pressure. Operation of the dump valve resets a timer controlling a pumping unit that drives the pump.

BRIEF DESCRIPTION OF THE DRAWINGS

The single FIGURE of the drawing is a schematic representation of the control system of this invention.

DESCRIPTION OF THE PREFERRED EMBODIMENTS

Referring to the drawing, a well indicated generally by reference numeral 10 is shown having casing 12 extending downwardly into a subsurface reservoir 14. Casing 12 is perforated as shown at 16 in the interval of the reservoir to permit reservoir fluids to flow into the well. Well 10 is provided at its upper end above ground surface 18 with a suitable wellhead structure indicated generally by reference numeral 20 for supporting the tubing, closing the annulus between tubing and casing, and delivering production from the well in accordance with conventional practice.

Extending down the well through casing 12 to the level of reservoir 14 is a string of tubing 22. Tubing 22 is suitably connected into wellhead structure 20 for the delivery of fluids from the well. Anchored in the tubing string 22 by a seating nipple 24 is a conventional reciprocating oil well pump 26. The pump 26 illustrated in the drawing has a standing valve 28 at its lower end and a traveling valve 30 at its upper end. This invention can be used with any reciprocating downhole pump and is not restricted to the specific type of pump indicated in the drawing. Sucker rods 32 connected to the upper end of pump 26 extend upwardly through the well and the wellhead structure for connection by means of a wireline hanger 33 to a pumping unit indicated generally by reference numeral 34.

Pumping unit 34 includes a horsehead 36 mounted directly above the wellhead structure on a walking beam 38 adapted to pivot about a center bearing 40 mounted on a suitable frame 42. A pitman 44 connected at one end to the end of the walking beam 38 opposite the horsehead 36 is driven by a crank 46 rotated by a speed reducer 48. Speed reducer 48 is driven by a prime mover 50 which may be, for example, an electric motor or an internal combustion engine.

Tubing string 22 is connected at its upper end as part of the wellhead structure with a delivery line 52 which is connected at its end remote from the tubing string to the inlet of a back pressure valve 54. The outlet of the back pressure valve 54 is connected to a transfer line 56 for delivery of well fluids to a midpoint of a displacement cell 58 having its upper end closed. In the embodiment shown in the drawings, a pressure gauge 61 is connected into the upper end of the displacement cell 58 for indication of the pressure in the cell, but such gauge is not essential to this invention.

Displacement cell 58 has an outlet at its lower end into which a discharge line 60 is connected for delivery of well fluids to the inlet of a dump valve 62 adapted to open at one preselected pressure and remain open until the pressure at the inlet of the valve drops to a preselected lower pressure. Dump valve 62 has an outlet that is connected to a flowline 64 for delivery of fluids from the well. Flowline 64 has a leg 65 connected into the annulus of well 10 and into a relief port in back pressure valve 54. Flow from the dump valve into the annulus is prevented by a check valve 66 and a normally closed valve 68. The relief port in back pressure valve 54 is normally closed by a rupture disc 69.

In the embodiment illustrated, the prime mover 50 is an electric motor. Current to prime mover 50 is delivered from a source 70 through a switch 72. If the pumping unit is driven by an internal combustion engine, switch 72 controls the electric current to the ignition of the engine. Switch 72 is actuated by a signal from a timer 74. Timer 74 is constructed and arranged to supply a signal that will keep switch 72 closed, and consequently pumping unit 34 operating, for a preselected period and then will open the switch unless the timer is reset as hereinafter described. A reset mechanism 76 actuated by operation of the dump valve 62 is connected to timer 74 to reset the timer 74 to the starting position each time the dump valve operates. A monitor 78 provides a record of the number of times the dump valve operates to drain fluids from the displacement cell 58.

For convenience in description, the volume of the displacement cell 58 above transfer line 56 is designated by the legend $V_1$ and the combined volume of that portion of the displacement cell below transfer line 56 and of discharge line 60 is designated by $V_2$. The total volume $V_1 + V_2$ is several times the volume displaced by a single stroke of pump 26. $V_1$ remains filled with gas at all times except for that part of the transfer line 56 that is occupied by liquid flowing from the wellhead into the displacement cell during the lifting stroke of pump 26. If the oil pumped from the reservoir contains a substantial amount of solution gas that is liberated as the oil travels up the well, the volume of gas in the displacement cell may be substantially larger than $V_1$. That will not interfere with the operation of the control system because dump valve 62 is responsive to the pressure at its inlet; not to whether the displacement cell contains liquid or gas.

In the operation of the apparatus of this invention, pump 26 pumps well fluids through tubing 22 and back pressure valve 54 into the displacement cell 58. Back pressure valve 54 can be set at any desired pressure, $P_1$, above the pressure, $P_2$, in flowline 64. In an arrangement preferred because of its simplicity, back pressure valve 54 is set to open at an absolute pressure twice the absolute pressure in flowline 64 and the volume $V_1$ is equal to the volume $V_2$. Well fluids are delivered into displacement cell 58 until the pressure in the displacement cell rises to $P_1$. At that time dump valve 62 opens and drains fluids from displacement cell 58 until the pressure in discharge line 60 drops to $P_2$. Gas in the displacement cell expands and forces fluids in the displacement cell through discharge line 60 and dump valve 62 into the flowline 64. The time required to drain fluids is preferably one-half or less the period of a full cycle of the suction and discharge stroke of pump 26. If pump 26 is operating at or above the preselected minimum efficiency, dump valve 62 will operate at intervals shorter than the interval set in timer 74 to open switch 72. The dump valve 62 then will operate reset 76 to return timer 74 to the starting position before timer 74 opens switch 72, and pumping unit 34 will continue to drive pump 26.

If the flow of liquid from the reservoir 14 into the well should be less than the rate at which pump 26 pumps liquids from the well, the liquid level in the well will drop to a level such that pump 26 does not lift a full cylinder volume of liquid on each stroke. If the amount lifted by the pump 26 is less than is required for the preselected minimum pump efficiency, the time required to build the pressure in the displacement cell 58 to the pressure at which dump valve 62 opens will exceed the time set on timer 74 to open switch 72. The timer 74 will then shut down the pumping unit for a period designed to allow liquid to flow from reservoir 14 into the well to increase the level of liquid in the well. Timer 74 is provided with a restart arrangement whereby it will close switch 72 after a shutdown period of a preselected time to restart pumping unit 34. Timer 74 is preferably additionally programmed to shut down the pumping unit permanently, and thus require manual restarting, if the timer should shut down the pumping unit a preselected number of times, for example three times, without an intervening resetting by operation of the dump valve.

The flow control system of this invention provides a direct control of a pumping unit based on the volume displaced by a reciprocating pump in the well. The system can be set to shut down a pumping unit when the pumping efficiency falls below a preselected minimum. For example, assume that $V_1 = V_2$, the total volume $V_1 + V_2$ is 9 gallons, the displacement, $V_p$, of pump 26 is 2.25 gallons, and $P_1 = 2P_2$. If the pump is pumping a liquid, the volume of liquid that is pumped into the displacement cell to raise the pressure from $P_2$ to $P_1$ is equal to one-half the volume of the displacement cell. Therefore, if the pump operates at 100 percent efficiency, the number of strokes, N, of a pump having a displacement volume $V_p$ required to dump the displacement cell is $$N = \frac{1/2\,(V_1 + V_2)}{V_p}$$

$$N = \frac{1/2\,(9)}{2.25} = 2 \text{ strokes}$$

Assuming a pump effiency of 10 percent, the number of pump strokes required to raise the pressure in the displacement cell is $$N = \frac{1/2\,(V_1 + V_2)}{\text{Eff. } V_p}$$

$$N = \frac{1/2\,(9)}{0.10\,(2.25)} = 20$$

The setting of timer 74 would then be to open switch 72 at the end of the time required for 20 strokes of pump 26.

Similarly, the efficiency at which a pump is operating can be determined from observation of the frequency, F, of operation of the dump valve. The efficiency can be calculated from the formula:

$$V_p \cdot N \cdot \text{Eff.} = \tfrac{1}{2}\,(V_1 + V_2) \cdot F$$

Assuming that the pumping unit is operating at 12 strokes per minute and the valve 62 dumps every 2 minutes:

$$\text{Eff.} = \frac{1/2\ (9) \cdot (.5)}{2.25\ (12)}$$

$$= 1/12 = .0833 = 8.33$$

The example described is merely an example of an embodiment preferred because it facilitates observation, and calculation of the efficiency, of the pump operation. Other ratios of $V_1$ to $V_2$ or $P_1$ to $P_2$ can be used, if desired.

The pump control system of this invention is responsive directly to the volume displaced by the downhole pump. The controls can therefore be easily set to shut down the pumping unit when the volume displaced is less than the volume that would be displaced by a pump operating at a minimum acceptable efficiency. Moreover, the control system allows the operator to determine the efficiency at which a pump is operating by observation of the frequency of operation of the dump valve. The controls provided will shut down the pumping unit in a manner to avoid periodic restarting of the pumping unit if the volume of fluids displaced is not adequate to operate the dump valve in a predetermined number of restarts of the pumping unit by the timer 74. If a sucker rod should break or the valve of the pump should leak sufficiently to prevent pumping of well fluids, the pump would be shut down until manually restarted by an operator who would determine and correct the cause of the pumping failure before restarting.

I claim:

1. A control system for a well having a wellhead at the ground surface, a downhole reciprocating well pump landed in the well, a pumping unit operatively connected to the well pump and driven by a prime mover, tubing extending from the well pump upwardly through the well to the wellhead, and a delivery line from the well communicating with the upper end of the tubing, comprising a back pressure valve adapted to open at a predetermined pressure having an inlet communicating with the delivery line and an outlet, a displacement cell closed at its upper end to flow outward therefrom and having an outlet at the lower end thereof and an inlet, said displacement cell having a volume larger than the displacement volume of the pump, a transfer line connecting the outlet of the back pressure valve with the inlet of the displacement cell, a discharge line extending from the outlet of the displacement cell, a dump valve in the discharge line, said dump valve being constructed and arranged to open at a first preselected pressure not exceeding the predetermined pressure and close at a second preselected pressure lower than the first preselected pressure and to drain the displacement cell in a period less than the full cycle of the pump, an energizing circuit for the prime mover, normally closed switch means in the energizing circuit, a timer in the energizing circuit operatively connected to the switch means adapted to open the switch means after a preselected period longer than the time for a full cycle of the pump, and reset means operatively connected to the timer and the dump valve constructed and arranged to reset the timer to the starting position on opening of the dump valve to prevent shutting down the prime mover.

2. A control system as set forth in claim 1 characterized by the prime mover being an electric motor, the energizing circuit being the electric power circuit to the electric motor, and the timer means being adapted to cut off electric power to the electric motor.

3. A control system as set forth in claim 1 characterized by the prime mover being an internal combustion engine, the energizing circuit being the ignition circuit of the engine, and the timer means being adapted to break the ignition circuit of said engine.

4. A control system as set forth in claim 1 characterized by the absolute pressure of the first preselected pressure being twice the absolute pressure of the second preselected pressure.

5. A control system as set forth in claim 1 characterized by the timer means including means to restart the prime mover a predetermined time after shutdown thereof.

6. A control system as set forth in claim 1 characterized by the timer means being adapted to permanently shut down the prime mover after a predetermined number of shut downs of the prime mover between successive operations of the dump valve.

7. A control system as set forth in claim 1 characterized by the inlet being at a midpoint of the displacement cell and the volume of the displacement cell above the inlet being equal to the sum of the volume of the displacement cell below the inlet and the volume of the discharge line between the outlet from the displacement cell and the dump valve.

8. A control system as set forth in claim 1 characterized by the absolute pressure of the first preselected pressure being twice the absolute pressure of the second preselected pressure, the total volume of the displacement cell and the discharge line to the dump valve exceeding the displacement volume of the pump, and the time required to drain fluid from the displacement cell through the dump valve being less than one-half the period of a full cycle of the downhole pump.

9. A control system as set forth in claim 1 characterized by the displacement cell having a total volume exceeding the displacement of the downhole pump and the time required to drain fluid from the displacement cell through the dump valve being less than one-half the period of a full cycle of the downhole pump.

10. A control system as set forth in claim 9 characterized by the total volume of the displacement cell and the discharge line to the dump valve being four times the volume of displacement of the downhole pump.

11. In a control system for a reciprocating downhole reciprocating oil well pump operated by a pumping unit driven by a prime mover for delivery of well fluids to a delivery line at the well head, the improvement comprising a back pressure valve in the delivery line, a displacement cell having a closed upper end, said displacement cell being connected to the outlet of the back pressure valve and having a volume several times the displacement volume of the pump, a dump valve adapted to open at a preselected opening pressure and close at a preselected closing pressure lower than the opening pressure, a discharge line from the lower end of the displacement cell to the dump valve arranged for delivery of fluids from the displacement cell into the dump valve, an energizing circuit for the prime mover, said energizing circuit comprising switch means and a timer operatively connected to the switch means adapted to open the switch means after a preselected period longer than the full cycle of the pump, and resetting means operatively connected to the timer and actuated by opening of the dump valve to reset the timer to a starting position, said dump valve and discharge line being constructed and arranged to drain the displacement cell in a period less than the full cycle of the pump.

* * * * *

UNITED STATES PATENT AND TRADEMARK OFFICE

CERTIFICATE OF CORRECTION

PATENT NO. : 4,118,148

DATED : October 3, 1978

INVENTOR(S) : Loy F. Allen

It is certified that error appears in the above-identified patent and that said Letters Patent are hereby corrected as shown below:

Column 6, line 28, "claim 1" should be --claim 7--.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*